US008479919B2

(12) United States Patent
Kaplan et al.

(10) Patent No.: US 8,479,919 B2
(45) Date of Patent: Jul. 9, 2013

(54) INJECTABLE FLUID VIAL HOUSING

(75) Inventors: Brian Kaplan, Palm Beach Gardens, FL (US); Robert Terwilliger, Palm Beach Gardens, FL (US); Richard Haskins, Palm Beach Gardens, FL (US); Paul Schlie, Durham, NH (US)

(73) Assignee: Accudial Pharmaceutical, Inc., Palm Beach Gardens, FL (US)

( * ) Notice: Subject to any disclaimer, the term of this patent is extended or adjusted under 35 U.S.C. 154(b) by 163 days.

(21) Appl. No.: 13/036,935

(22) Filed: Feb. 28, 2011

(65) Prior Publication Data

US 2012/0006712 A1 Jan. 12, 2012

Related U.S. Application Data

(60) Provisional application No. 61/362,667, filed on Jul. 8, 2010.

(51) Int. Cl.
*B65D 85/00* (2006.01)

(52) U.S. Cl.
USPC ..... 206/459.5; 206/438; 206/570; 40/310

(58) Field of Classification Search
USPC ..... 206/438, 570, 459.5, 232, 534, 538, 206/528; 220/4.24, 4.25; 40/310
See application file for complete search history.

(56) References Cited

U.S. PATENT DOCUMENTS

| | | | | |
|---|---|---|---|---|
| 3,275,180 | A * | 9/1966 | Optner et al. | 206/521 |
| 3,634,994 | A * | 1/1972 | Dunne | 53/460 |
| 3,980,117 | A * | 9/1976 | Trombley | 220/376 |
| 4,211,333 | A | 7/1980 | Villarejos | |
| 4,306,357 | A | 12/1981 | Villarejos | |
| 4,449,640 | A | 5/1984 | Finkelstein | |
| 4,577,474 | A * | 3/1986 | Peterson | 62/457.4 |
| 4,586,622 | A | 5/1986 | Walldorf | |
| 4,871,977 | A | 10/1989 | Schilling et al. | |
| 5,078,267 | A | 1/1992 | Wright | |
| 5,158,209 | A * | 10/1992 | Reil et al. | 222/129 |
| 5,433,324 | A * | 7/1995 | Leonard | 206/534 |
| 5,735,422 | A * | 4/1998 | Binter | 220/4.21 |
| 5,884,421 | A | 3/1999 | Key | |
| 6,086,697 | A | 7/2000 | Key | |
| 6,227,371 | B1 * | 5/2001 | Song | 206/534 |
| 6,237,269 | B1 | 5/2001 | Key | |
| 6,276,533 | B1 | 8/2001 | Kaplan | |
| 6,385,878 | B1 | 5/2002 | Key | |
| 6,402,872 | B1 | 6/2002 | Key | |

(Continued)

FOREIGN PATENT DOCUMENTS

| | | |
|---|---|---|
| WO | WO0006455 | 2/2000 |

*Primary Examiner* — David Fidei
(74) *Attorney, Agent, or Firm* — McHale & Slavin, P.A.

(57) ABSTRACT

A container for housing an injectable fluid vial. The container includes a calculation aid formed specific to the injectable fluid vial. The container is formed from a bottom, a top, and an inset side wall therebetween with a resealable lid. The top includes an opening constructed and arranged to receive the fluid vial housing. Alternatively, the container is formed from two half sections that are hinged together for holding the fluid vial housing therebetween. An inner label is permanently attached to the sidewall having at least one row of dosing indicia coordinated with a base line indicia selected from the group of weight, age, fluid volume or area. An outer label is rotatably secured over said inner label with at least one transparent window allowing selective viewing of the dosing and base line indicia and predetermined dosing rate.

14 Claims, 4 Drawing Sheets

U.S. PATENT DOCUMENTS

| | | | | |
|---|---|---|---|---|
| 6,581,773 | B2 | 6/2003 | Kaplan | |
| 6,631,578 | B2 | 10/2003 | Key | |
| 6,649,007 | B1 | 11/2003 | Key | |
| 7,087,298 | B2 | 8/2006 | Key | |
| 7,172,668 | B2 | 2/2007 | Key | |
| 2010/0038273 | A1* | 2/2010 | Johnson | 206/459.5 |
| 2010/0140116 | A1* | 6/2010 | Stiene et al. | 206/204 |
| 2011/0094909 | A1* | 4/2011 | Leabeater et al. | 206/365 |

* cited by examiner

INJECTABLE FLUID VIAL HOUSING

PRIORITY CLAIM

This application claims a priority date of Jul. 8, 2010, based upon U.S. Provisional Patent Application No. 61/362,667 entitled "Injectable Fluid Vial Housing," the contents of which are incorporated herein by reference.

FIELD OF THE INVENTION

This invention relates generally to injectable fluid vials potentially containing medicine, vital fluids, and/or nutritional supplements and, more particularly, to a fluid vial container that incorporates a calculation aid to provide dosage level based upon weight, age, volume, or area.

BACKGROUND OF THE INVENTION

Dosing of injectable fluids by prescription based upon a patient's weight, age or other means of estimating the patient's fluid volume is known in the art. However, the means of calculation the dosing amount is cumbersome and potentially contributing to the incorrect dosing of an intended recipient should any of the base line factors change or an error made in calculation.

Although methods are known by which dose calculating aides may be integrated with typically sized bottles, injectable fluid vials tend to be substantially smaller and thereby greatly limit the practical area available to do so.

The currently available dosage calculations presented on charts and pinwheels are not readily available to the general public. Further, the dosage amount may be based on volume, area or age which can change leaving the individual to seek professional assistance to recalculate the dosage amount. Even if a physician's reference manual is available, the reference can present a confusing array of dosages that may not be understood by the general consumer.

For example, a first responder may carry a host of injectable fluids that are stored in vials to treat various types of accident victims. Upon reaching an accident victim, the first responder is assaulted with a confusing array of possible injuries yet is called upon to immediately provide relief for pain or otherwise stabilize the injured individuals. However, in the midst of the confusion a doctor may not be reached and the first responder may be called upon to determine dosage levels based upon weight, age, fluid volume or area. It is unrealistic to expect a first responder, or even a seasoned physician, to remember all the required doses for all injectable fluids.

The proper dosing of any medication is imperative as is the need to assure that the medication being injected will actually assist the patient. For this reason it is well recognized that dosing calculations performed well before application lessen the possibility of over/under dosing.

The Applicant recognized the need for proper elixir dosing based upon weight versus age for children. U.S. Pat. Nos. 6,276,533 and 6,581,773 discloses the need for a weight based dosing regimen for pediatric elixirs, and disclosed a container mounted rotating calculation aid to provide proper dosing at the time of delivery. It is now well recognized that a 12 year old boy may weight 60 lbs or 160 lbs wherein dosing based upon age could lead to over/under dosing.

A number of patents were issued to inventor Key which disclose an apparatus and method of constructing a rotating label system including U.S. Pat. Nos. 5,884,421; 6,086,697; 6,237,269; 6,631,578; 6,385,878; 6,402,872; 6,649,007; 7,087,298; and 7,172,668. The disclosures provide for a rotating label that is placed around a container, the rotating label including a viewing window to view indicia placed on an inner label. The patents are directed to a system and method for constructing a rotatable label and attaching the label to a container. Key does not disclose a container for housing another container, and thus would not disclose any teaching for the matching of two containers.

Tamper resistant vial containers are also known, such as the placement of a plastic or a metal seal over the mouth of the container beneath the screw cap. U.S. Pat. No. 4,871,977 discloses a barb or hook inside an open upper end of a vial, providing a cap adapted for insertion into the vial having a mating hook formed about a lower edge thereof, and providing sealing rings formed on the outer surface thereof, thereby yielding a tamper-resistant, leak-proof sealing between the enclosure and the vial.

U.S. Pat. Nos. 4,586,622 and 4,449,640 describe an open-top vial covered by a cap having a depending peripheral skirt, in such a way that an inner surface of the cap skirt and an outer surface of the cap are provided with complementary mating interlock elements. The cap comprises an integral tear member, defined by at least one weakened, partially circumferential weakened junction lines, such that pulling away the tear member along the junction line allows both annual removal of the cap and ready visual confirmation that vial integrity has been breached.

U.S. Pat. Nos. 4,211,333 and 4,306,357 disclose a vial having a flange about its opening so that, below the flange and spaced apart therefrom, a shoulder defines an indented neck therebetween. An overcap extends over the flange and about the neck to form a skirt about the neck. The skirt has at least a portion thereof extending inwardly in gripping reaction with the neck and limited in removal by contact with the underside of the flange, whereby the cap cannot be removed without destroying a structural integrity thereof.

No known prior art exists for combining an injectable fluid vial with a security container having a calculation aid for dosing.

SUMMARY OF THE INVENTION

The present invention provides a container for housing an injectable fluid vial, the container includes a calculation aid formed specific to the injectable fluid vial. The container is defined by a bottom, a top, and an inset side wall therebetween. The top includes a covered opening constructed and arranged to receive the injection fluid vial housing. Alternatively, the container is formed from two half sections that are hinged together for holding the fluid vial housing therebetween. An inner label is permanently attached to the inset sidewall providing a dosing surface with at least one row of base line indicia selected from the group of weight, age, fluid volume or area and at least one row of a predetermined dosing rate. An outer label is rotatably secured over the inner label with at least one transparent window allowing selective viewing of the dosing and base line indicia.

An objective of the instant invention is to provide a container for a conventional injectable fluid vial housing providing sufficient surface area for inclusion of a dosing calculation aid and providing a means of protecting the fluid vial from tampering.

Still another objective of the invention is to provide a container having an inset sidewall to allow for ease of rotation of a rotating dosing calculation aid.

Another objective of the instant invention is to provide a more accurate and/or convenient method by which injectable medication, vital fluid, and/or nutritional supplement dosing may be determined.

Yet still another objective of the invention is to provide a container for an injectable fluid vial housing that can be keyed so that it will only hold a particular fluid vial so as to reduce or eliminate the possibility that the wrong calculation aid is used with a fluid vial.

Another objective of the invention is to provide a container having a lid that allows for concealment of an injectable fluid vial housing when not in use and further protecting the needle entry grommet from contamination.

Yet another objective of the invention is to provide an insulated container for an injectable fluid vial housing wherein the insulator moderates fluid temperature change.

Still another objective of the invention is to provide a container for an injectable fluid vial housing that includes spacers to contain the vial housing in a centrally disposed position and cushion the vial from impact.

Another objective of the invention is to provide a container for an injectable fluid vial housing having a lid that is tamper resistant.

Another objective of the invention is to provide a container for an injectable fluid vial housing having a lid that includes a tamper-evident cover.

Still another objective of the invention is to provide a container that is economical to manufacture and recyclable.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE PREFERRED EMBODIMENT

Figure 1:
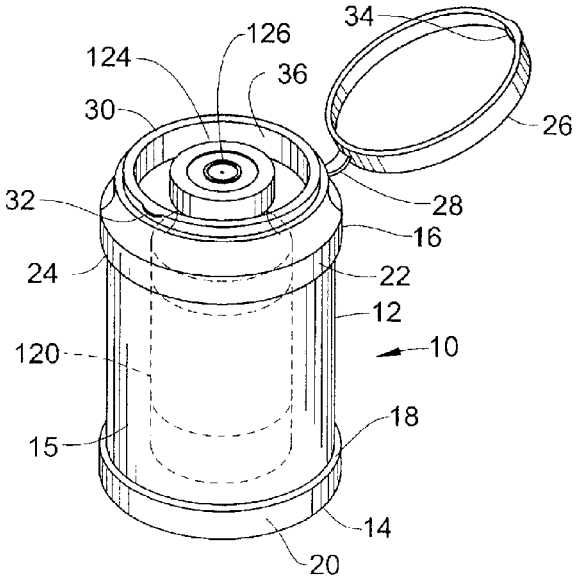
FIG. 1 is a perspective view of a container of the instant invention holding a conventional injectable fluid vial housing.
Figure 2:
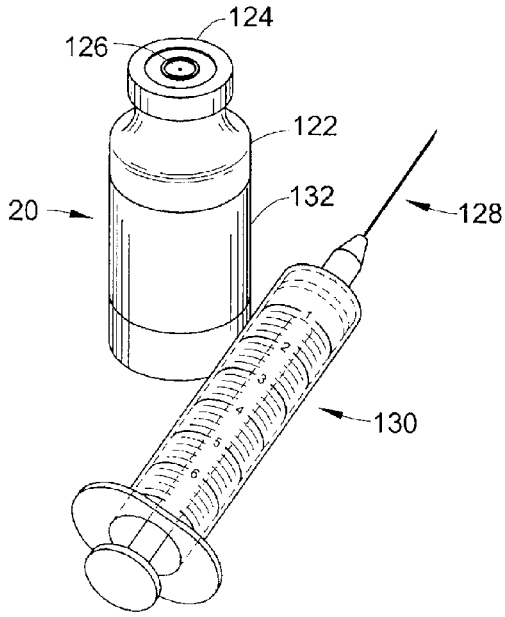
FIG. 2 is a pictorial view of a conventional injectable fluid vial housing and a conventional syringe.

Now referring to the Figures in general and specifically FIGS. 1 and 2, set forth is a container 10 formed from continuous inset sidewall 12 having bottom section 14 and top section 16. The bottom section 14 may be attached to the inset sidewall 12 or preferably formed integral thereto having a lower transition area 18. The lower transition area 18 is formed by use of an inset sidewall 12 having an outer diameter less than the outer surface sidewall 20 of the bottom section 14; the transition area 18 is preferably formed at a right angle to the inset sidewall 12 and outer surface sidewall 20. Similarly an upper transition area 24 is formed at a right angle to the inset sidewall 12. The inset sidewall 12 has an outer diameter less than the outer surface sidewall 22 of the upper section 16. The use of right angle transition areas 18 and 24 allow the use of a rotating label, as will be further explained in this specification, with sufficient tolerance to allow ease of rotation without disengagement from the container.

The upper section 16 includes an access opening 30 constructed and arranged to receive a lid 26 into a snap-lock position by use of engagement tab 32 positioned along the entry wall 36 and reciprocal engagement tab 34 positioned along the inner edge of the lid 26. The engagement tabs allowing the lid to frictionally engage the entry wall to enclose the contents of the container. The opening 30 on the upper section 16 is sized for receipt of a conventional fluid vial 120. The upper section 16 includes the lid 26 attached by a living hinge 28.

A conventional fluid vial 120 has a glass body 122 with a needle piercing cap 124 having a grommet 126 that allows passage of a needle 128 from a conventional syringe 130. Fluid vials are typically small glass containers which are known for the non-leaching characteristics providing stability to the contents of the vial. Small vials are used due to the limited amount of fluids that are stored in the vial, due to expense, sterility, storage stability or any combination thereof. The result is a fluid vial that is very small having limited room for a label 132. For instance, the vial may contain an injectable fluid that has a short shelf life, is temperature and light sensitive. The problem with the vial being small is that the amount of information that could be placed on the label 132 can be limited. When dosing is required, such as during an emergency, the ability of the individual that is calculating the dosing amount must have readily access to the proper dosing level for the individual so as to allow for effective use of the fluid. The conventional glass vial does not protect against temperature and light degradation unless specifically colored or coated.

The container of the instant invention is preferably sized to hold a conventional fluid vial 120. The container 10 includes sufficient spacing around the fluid vial 120 to include insulation 15 if fluid within the vial needs temperature stabilization, or the container 10 may simply include spacers so as to prevent the vial from movement and provide impact cushion. While the main function of the container will be for increasing the labeling readability and incorporation of a calculation aid, it should be noted that a container can also provide an anti-tamper lid such as a ratchet design, key lock opening, and so forth, not shown. Further, the use of plastic shrink wrap around the container lid 26 provides evidence of improper tampering.

Figure 3:
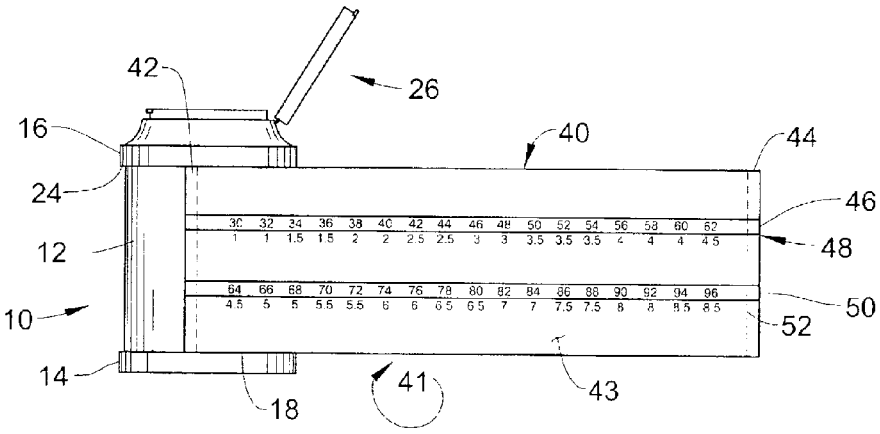
FIG. 3 is a plane side view of the container with a dosing label attached along a leading edge.
Figure 4:
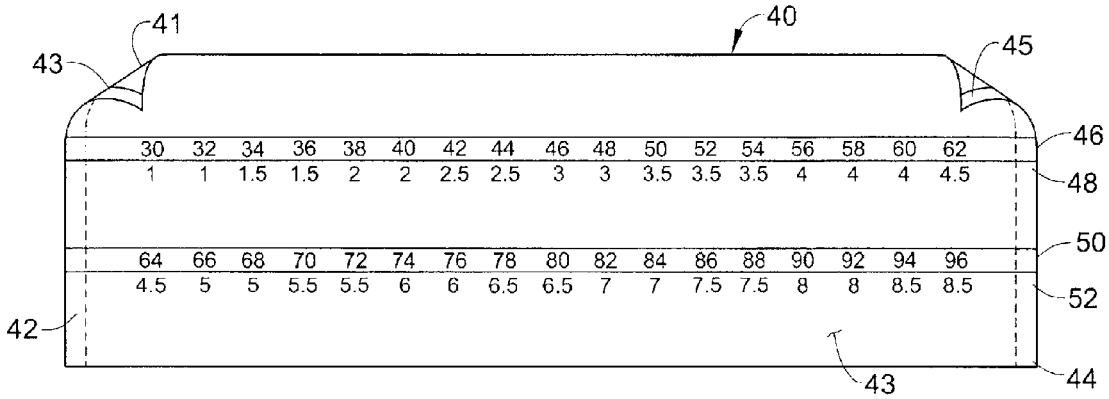
FIG. 4 is a plane front view of the dosing label.
Figure 5:
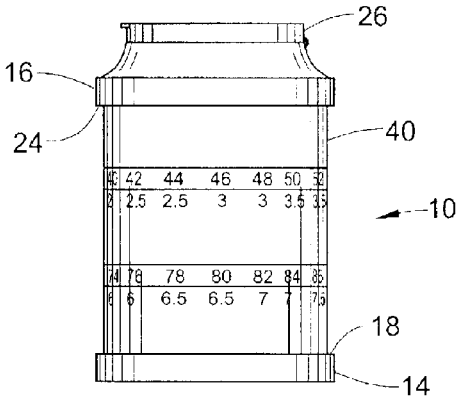
FIG. 5 is a plane side view of the container with the dosing label attached thereto.

Referring now to FIGS. 3-5, the container 10 has an inner label 40 it is attached to the inset sidewall 12 by placement of adhesive on the back 41 of leading edge 42 secured to the inset sidewall 12. Similarly, adhesive is placed on the back 41 of trailing edge of the label 40 and when the label is wrapped around the container it is securely joined to the container in a permanent fashion.

The inner label 40 includes multiple rows of weights and dosing indicia placed on the front surface 43. The indicia illustrated is for example only and can be displayed in volume, units, weight, age, ml, units, etc. . . . and any combination thereof that the manufacturer or physician employs. The example illustrated depicts a base line indicia 46 having children weights from 30 lbs to 62 lbs and a dosing line of indicia being the calculated dose for an individual based upon the weight. For example a 58 lb child may be injected with 4 units of the contained fluid held within the vial 120.

Further to this example a second row 50 of indicia indicates weights from 64 lbs to 96 lbs and a dosing rate indicia line 52 of 4.5 units to 8.5 units. In this example an 82 lb child would have a dosing rate of 7 units. While the underlying label provides the dosing indicia on tables that can be commonly found in physicians handbooks the particular label allows for customization of indicia that is appropriate only for fluid within the vial to allow the individual that will be injecting the fluid an instant reference of the appropriate amount without further calculation or reference materials. Various mechanisms can further be used to coordinate the container 10 to the vial 120 including color coating of labels, color coating of containers, or coordinated sizes to make sure that the vial 120 and the container 10 are matched. The vial 120 can be permanently secured within the container 10 so that only the cap section 124 of the vial 120 is accessible. Further, the vial can be permanently captured within the container wherein the fluid is drawn directly from the grommet 126 without removal of the vial.

Label 40 includes the use of a permanent adhesive 43 along leading edge 42 and adhesive 45 along tailing edge 44. Alternatively the adhesive can be placed all across the back of the label 40; the amount of permanent adhesive to accomplish the necessary securement is dependent on the label material. A plastic film requires adhesive along the leading and trailing edges as the film is resistant to tearing. A label made from thin paper will likely need adhesive on a substantial portion of the back surface 41 to prevent premature removal. Once the leading edge is secured the label 40 is wrapped around the container, as shown in FIG. 5, with the trailing edge abutting the leading edge. The label 40 is held within the transition sections 18 and 24 covering the inset sidewall 12.

Figure 6:
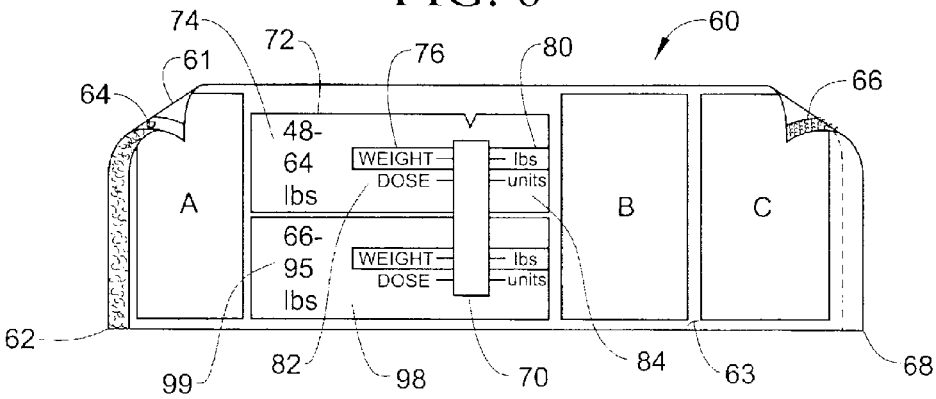
FIG. 6 is a plane front view of outer label.
Figure 7:
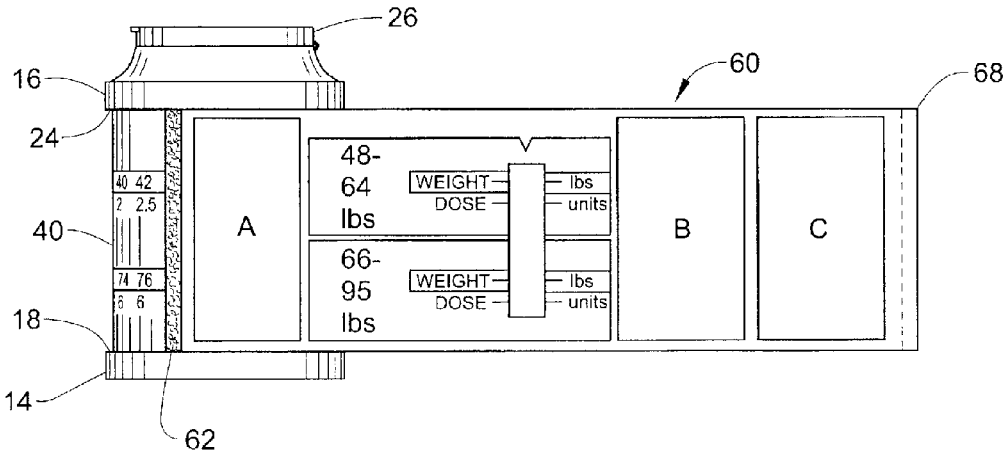
FIG. 7 is a plane side view of the container with an outer label attached to the dosing label along a leading edge.
Figure 8:
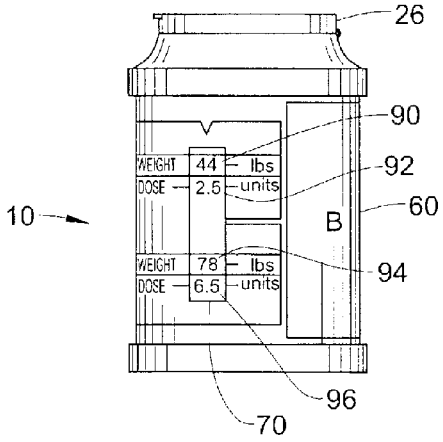
FIG. 8 is a plane side view of the container depicting a first dosing amount.

Referring now to FIGS. 6-8 set forth is the upper label 60 having a leading edge 62 having temporary adhesive dot placed along the back surface 61 thereof and an area of permanent adhesive 66 placed along the back surface 61 of the trailing edge 68. The outer label 60 is wrapped around the inner label 40 allowing the adhesive 66 placed along the back surface 61 of the trailing edge 68 to overlap the front surface 63 of the leading edge 62 of the outer label 60, and be attached thereto. The temporary adhesive dot 64 will dry and disintegrate within twenty four hours of application wherein the adhesive bond is lost. The adhesive placed along the back surface 61 of the trailing edge 68 will dry with a permanent adhesion to the frontal surface 63 of the outer label 60. The outer label 60 can then be rotated which will easily break any bond left with the temporary adhesive dot 64 allowing the outer label 60 to be rotated relative to the inner label 40. One skilled in the art will recognize that various types of adhesive can be used to accomplish the intended results, further the location of the adhesive need not be on the exact positions depicted yet still accomplish the same result. For instance, the leading edge of the outer label may have an adhesive dot 64 placed on the back surface 61 and the adhesive strip placed on the trailing edge 68 of the front side surface 63.

The leading edge 62 is temporarily attached to the label 40 by the adhesive dot 64 allowing the label 60 to wrap around the inset sidewall 12 of the container 10 until the trailing edge 68 overlaps the leading edge 62 wherein the permanent adhesive 66 attaches to bond the label in a continuous loop. In this manner the temporary adhesive 64 maintains the outer label in position only until it dries and dissolves wherein outer label 60 is free to rotate around the label 40. The outer label includes a window aperture 70 that is constructed and arranged to be placed over the calculation aid indicia so as to reveal only the indicia as specified by the label. By way of example, outer label 60 is shown with an upper box 72 having a description of weight 74 showing a weight row 76 depicting the measurement term 80 which in this example is lbs. A second row describing the dose 82 and the unit size 84 which in this example is units. The label 60 is rotated to allow the window 70 to be placed over the 44 lbs weight indicating a dosage rate 92 of 2.5 units. Similarly a second level of indicia 94 indicates a weight of 78 lbs and a dosage rate of 6.5 units 96.

Figure 9:
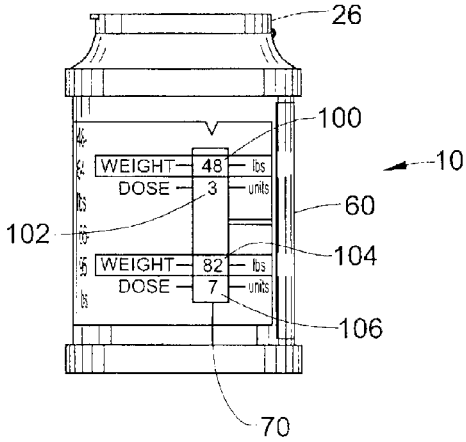
FIG. 9 is a plane side view of the container depicting second dosing amount.

The outer label 60 includes sufficient area so that descriptions can be added in various sections A, B, & C without the need for miniaturization of print. To further enhance the readability of the label, weight columns 46 and 50 may be shaded or placed in a color to correspond with the weight row 76 and lbs row 80 assuring that the alignment of the word "weight" the weight amount, and the "units" in lbs can be easily distinguished. The dosage label, the amount, and the label may be un-shaded for ease of readability. The dosage box 72 may include a single window 70 or may include a second box 98 which duplicates first box with a different weight amount 99. As shown in FIG. 9 the outer label 60 can be rotated so that the window aperture 70 now depicts the weight 100 of 48 lbs with a dosage 102 of 3 units and the second box depicts a weight of 82 lbs 104 with a dosage rate 106 of 7 units.

For example, an individual with Type 1 diabetes requires daily doses of insulin to keep blood glucose levels from going too high. Insulin is a hormone produced by the beta cells of the pancreas that permits glucose to enter cells and helps the body use glucose for energy. People who are Type 1 diabetic must use manufactured insulin, usually in an injectable form, to replace the natural insulin that is no longer produced by their body. At mealtime the individual may calculate the carbohydrate coverage insulin dose at a meal, wherein the CHO insulin dose=Total grams of CHO in the meal÷grams of CHO disposed by 1 unit of insulin (the grams of CHO disposed of by 1 unit of insulin is the bottom number or denominator of the Insulin:CHO ratio). Thus, if an individual having type 1 diabetes plans for 60 grams of carbohydrate for lunch wherein their Insulin CHO ratio is 1:10. The CHO insulin dose=Total grams of CHO in the meal (60 g)÷grams of CHO disposed by 1 unit of insulin (10)=6 units. The individual will need 6 units of rapid acting insulin to cover the carbohydrate. The base line indicia can be displayed in the form carbohydrate levels allowing the individual to determine insulin dosage rate without further calculation aid.

By weight, basal and bolus doses for an estimated daily insulin dose is made by calculating the Total Daily Insulin Requirement (in units of insulin)=Weight in Pounds÷4. Assuming a child weights 80 lbs the total insulin dose=80 lb÷4=20 units of insulin/day. The indicia can track weight allowing the individual to determine dosage without further calculation aid.

Common children's injectables that are determined by weight include, by way of example:

NeoProfin—Ibuprofen, a nonsteroidal anti-inflammatory drug. Dosing, having a weight greater than or equal to 0.5 kg and less than 1.5 Kg: 10 mg/kg IV initial dose, followed by two doses of 5 mg/kg each, after 24 hours and 48 hours.

Avinza—Morphine, a narcotic pain medication. Dosing to Pediatric=0.5 mg/kg with a Max Dose: 0.1 mg/kg. Greater than or equal to 1 month, but less than 12 years: 0.005-0.02 mg/kg IM.

Dilaudid—Hydromorphone, a narcotic pain medication has an initial dose: 0.001 mg/kg; from 1-12 years=0.015 mg/kg initial dose.

Dilantin—Phenytoin, an antiepileptic drug. Initially, 5 mg/kg/day in two or three equally divided doses, with subsequent dosage individualized to a maximum of 300 mg daily. A recommended daily maintenance dosage is usually 4 to 8 mg/kg. Children over 6 years old and adolescents may require the minimum adult dose (300 mg/day).

Fuzeon—enfuvirtide, an antiviral medication in a group of HIV medicines. In pediatric patients 6 years through 16 years of age, the recommended dosage is 2 mg/kg twice daily up to a maximum dose of 90 mg twice daily injected subcutaneously into the upper arm, anterior thigh or abdomen.

Garamycin—Gentamicin an antibiotic having Pediatric Dose for Bacterial Infection: 0 to 4 weeks, birthweight<1200 g: 2.5 mg/kg IV or IM every 18 to 24 hours; 0 to 1 week, birthweight>=1200 g: 2.5 mg/kg IV or IM every 12 hours; 1 to 4 weeks, birthweight 1200 to 2000 g: 2.5 mg/kg IV or IM every 8 to 12 hours; 1 to 4 weeks, birthweight>=2000 g: 2.5 mg/kg IV or IM every 8 hours; and >1 month: 1 to 2.5 mg/kg IV or IM every 8 hours. Usual Pediatric Dose for Bacterial Endocarditis Prophylaxis 1.5 mg/kg IV or IM once within 30 minutes of starting the procedure. For high risk patients, in addition to gentamicin, ampicillin 50 mg/kg (maximum 2 G) is given IV or IM 30 minutes prior to the procedure, followed by ampicillin 25 mg/kg IV/IM or amoxicillin 25 mg/kg orally 6 hours later. In penicillin-allergic patients, vancomycin 20 mg/kg IV is infused over 1 to 2 hours instead of ampicillin/amoxicillin.

Increlex—Mecasermin is an insulin-like growth factor-1 (IGF-1) –2 years old to adult (closed epiphyses): initial dose: 0.04 to 0.08 mg/kg twice daily by subcutaneous injection. If well tolerated for at least one week, the dose may be increased by 0.04 mg/kg per dose to the maximum of 0.12 mg/kg given twice daily.

Kefzol—Cefazolin, an antibiotic. Dosing-Postnatal=20 mg/kg; 1 month or older=6.25-25 mg/kg.

Omnitrope—Somatropin, Human Grown Hormone. Pediatric Grown Hormone Deficiency: Generally, a dosage of 0.16-0.24 mg/kg weight/week is recommended. PraderWilli Syndrome: Generally, a dosage of 0.24 mg/kg week is recommended. Small for Gestational Age (SGA): generally, a dosage of up to 0.48 mg/kg body weight/week is recommended.

Rocephin—Ceftriaxone, an antibiotic for the treatment of skin structure infections, the recommended total daily dose is 50 to 75 mg/kg given once a day. For the treatment of acute bacterial otitis media, a single intramuscular dose of 50 mg/kg. For the treatment of serious miscellaneous infections, the recommended total daily dose is 50 to 75 mg/kg, given in divided doses every 12 hours (total daily dose should not exceed 2 grams). In the treatment of meningitis, the recommended initial dose is 100 mg/kg.

The examples illustrate but a few use of the calculation aid and demonstrate that even a trained medical profession is confronted with numerous injectables that have dissimilar dosing requirements. Further, this application is not limited to the type of medication or the use of either an insulated container or cushioned container further allows the fluid vials to hold most any type of fluid that benefits from a calculation chart or table.

The inner label 40 and outer label 60 can be made of paper or plastic film or any other appropriate material. A plastic label, or plastic film, provides for ease of use with the plastic file allowing ease of rotation. The paper label allows for individualized printing by a caregiver from a conventional printer to allow customization of the level to a particular dosing rate. For instance, if combination of medications can be combined, the caregiver may prepare a dosage rate specifically for a patient. A computer software program allows for the inclusion of specific instructions onto the inner and outer label, the program employing a template that assures proper alignment of the base indicia and dosage rate. A kit can be provided which includes laser or ink jet labels, template software, and container blanks to allow proper positioning of all indicia in relation to the label opening aperture of the instant invention.

Figure 10:
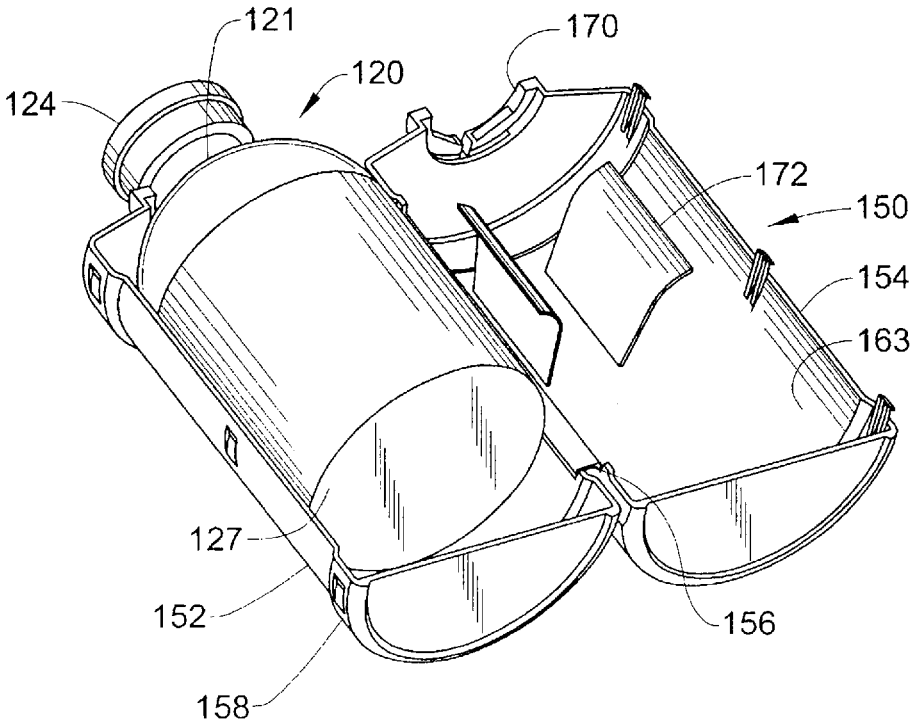
FIG. 10 is a perspective view of an embodiment formed from two half sections hinged together.
Figure 11:
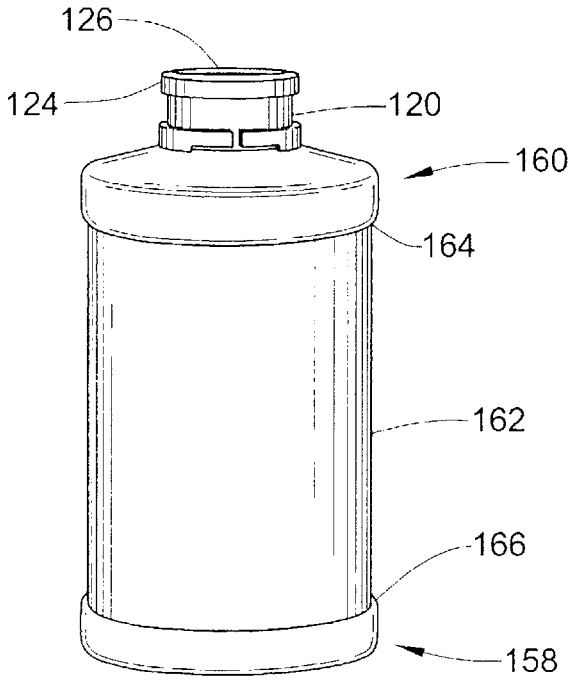
FIG. 11 is front plane view thereof.

FIGS. 10 and 11 depict a second embodiment for the container 150 for housing an injectable fluid vial housing 120 wherein the container is formed in the shape of an open top bottle. The container 150 has a first half 152 hingedly coupled 156 to a second half 154. When placed in closed position the container resembles an open bottle with a bottom section 158, a top section 160, and a side wall 162 therebetween. In the closed position, the sidewall 162 is continuous and similar to the first embodiment, an upper transition section 164 forms a right angle wall between the upper section 160 and the sidewall 162, and a lower transition section 166 forms a right angle wall between the lower section 158 and the sidewall 162.

The top section 160 includes a collar 170 that forms around the neck 121 of the fluid vial and spacers 172 formed along the inner sidewall 163 maintain the fluid vial 120 in a centrally disposed position. The container can be sized to accept different width fluid vials wherein the spacers 172 flex to accommodate oversized fluid vials. The bottom 158 may also be positioned a distance from the bottom of the fluid vial 127 allowing for taller fluid vials. If the fluid needs to be maintained at a stable temperature, the spacing and open area sounding the fluid vial within the container can include an insulating material.

When the fluid vial 120 is captured within the container 150, only the cap 124 of the fluid vial is available, all labeling is now provided on the sidewall 162 as previously described in the first embodiment. Further, the label placed around the sidewall provides a tamper-evident shield to assure that the fluid vial placed within the container has not been tampered with.

While detailed embodiments of the instant invention are disclosed herein, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A container for an injectable fluid vial housing comprising:

a container having a bottom, a top, and a sidewall therebetween, said side is formed from a first half hingedly coupled to a second half, said first half latching to said second half forming a continuous sidewall, said container sized to receive an injectable fluid vial housing therein;

an inner label defined by a back surface and a front surface, said back surface having a first permanent adhesive for securement to said continuous side surface, said front surface having at least one row of dosing indicia and at least one row of base line indicia;

an outer label defined by a rear surface and a front surface with a leading edge and a trailing edge, at least one transparent window located between said leading and trailing edge;

a temporary adhesive attached to the rear surface leading edge of said outer label, said temporary adhesive providing temporary securement of said outer label to said inner label;

a second permanent adhesive attached to said front surface leading edge of said outer label, said outer label wrapped around said inner label with said rear surface trailing edge adhering to said front surface outer edge;

wherein said temporary adhesive has lost its adhesive attachment allowing said outer label to rotate about said inner label whereby said transparent window allows selective viewing of said base line indicia and dosing rate.

2. The container for an injectable fluid vial housing according to claim 1 wherein said sidewall is inset a distance at a right angle to said outer surface of said top and said bottom.

3. The container for an injectable fluid vial housing according to claim 1 wherein said base line indicia is selected from the group consisting of weight, age, fluid volume or area.

4. The container for an injectable fluid vial housing according to claim 1 wherein a fluid vial is inserted through an opening in said top.

5. The container for an injectable fluid vial housing according to claim 4 including a lid attached to said top by a living hinge, said lid enclosing a fluid vial within said container.

6. The container for an injectable fluid vial housing according to claim 1 wherein said container is insulated to maintain fluid at a prolonged constant temperature.

7. A container for an injectable fluid vial housing comprising:

a container having a bottom, a top, and an inset continuous side wall therebetween, said top having an opening sized to receive an injection fluid vial housing into said container;

a spacer placed within said container for holding the injectable fluid vial housing in a centrally disposed position;

a lid for securing said injection fluid vial housing within said container;

an inner label defined by a back surface and a front dosing surface, said back surface having a first permanent adhesive for securement to said inset continuous side surface, said dosing surface having at least one row of dosing indicia with base line indicia selected from the group of weight, age, fluid volume or area;

an outer label defined by a rear surface and a front surface with a leading edge and a trailing edge, at least one transparent window located between said leading and trailing edge;

a temporary adhesive attached to said rear surface leading edge of said outer label, said temporary adhesive providing temporary securement of said outer label to said inner label;

a second permanent adhesive attached to said front surface leading edge of said outer label, said outer label wrapped around said inner label with said rear surface trailing edge adhering to said front surface outer edge;

wherein said temporary adhesive has lost its adhesive attachment allowing said outer label to rotate about said inner label whereby said transparent window allows selective viewing of said dosing and base line indicia.

8. The container for an injectable fluid vial housing according to claim 7 wherein said inset continuous sidewall includes a right angle transition surface from said top and said bottom.

9. The container for an injectable fluid vial housing according to claim 7 wherein said lid is attached to said top by a living hinge.

10. The container for an injectable fluid vial housing according to claim 7 wherein said container is insulated to maintain fluid at a prolonged constant temperature.

11. A container for an injectable fluid vial housing comprising:

a container formed in the shape of an open top bottle, said container having a first half hingedly coupled to a second half, with a bottom section, a top section, and a side wall therebetween, said container constructed and arranged to receive an injectable fluid vial housing therein;

an inner label defined by a back surface and a front dosing surface, said back surface having a first permanent adhesive for securement to said sidewall, said dosing surface having at least one row of dosing indicia with base line indicia selected from the group of weight, age, fluid volume or area;

an outer label defined by a rear surface and a front surface with a leading edge and a trailing edge, at least one transparent window located between said leading and trailing edge;

a temporary adhesive attached to said rear surface leading edge of said outer label, said temporary adhesive providing temporary securement of said outer label to said inner label;

a second permanent adhesive attached to said front surface leading edge of said outer label, said outer label wrapped around said inner label with said rear surface trailing edge adhering to said front surface outer edge;

wherein said temporary adhesive has lost its adhesive attachment allowing said outer label to rotate about said inner label whereby said transparent window allows selective viewing of said dosing and base line indicia.

12. The container for an injectable fluid vial housing according to claim 11 wherein said sidewall is continuous when said first and said half sections are joined together, said sidewall is inset.

13. The container for an injectable fluid vial housing according to claim 11 wherein said container is insulated to maintain fluid at a prolonged constant temperature.

14. The container for an injectable fluid vial housing according to claim 11 wherein said container includes a means for spacing said injectable fluid vial housing in a centrally disposed position within said container.

* * * * *